United States Patent [19]

Vona

[11] 4,318,577

[45] Mar. 9, 1982

[54] BULK FOOD DISPLAY BIN

[75] Inventor: Romanino Vona, Milton, Canada

[73] Assignee: Bunsmaster Bakeries of America, Inc., Milton, Canada

[21] Appl. No.: 150,203

[22] Filed: May 15, 1980

[30] Foreign Application Priority Data

May 12, 1980 [CA] Canada ..... 351706

[51] Int. Cl.[3] ..... A47B 71/00

[52] U.S. Cl. ..... 312/284; 312/286; 312/242; 312/122; 312/124; 232/43.1; 186/33

[58] Field of Search ..... 312/284, 283, 286, 242, 312/119, 122, 124, 211, 35, 42, 60, 73; 232/1 E, 43.1, 43.4, 43.5; 186/33

[56] References Cited

U.S. PATENT DOCUMENTS

| | | | |
|---|---|---|---|
| 557,095 | 3/1896 | Tate | 312/211 |
| 806,719 | 12/1905 | Winchel | 312/124 |
| 883,990 | 4/1908 | Warren | 312/211 |
| 1,659,230 | 2/1928 | Zacharias | 312/124 |
| 2,352,685 | 7/1944 | Brinker | 232/43.1 |
| 2,486,724 | 11/1949 | Weber et al. | 312/286 |
| 2,612,896 | 10/1952 | Fox | 232/43.1 |
| 3,541,701 | 11/1970 | Barnes | 312/60 |
| 3,776,419 | 12/1973 | Zinkgraf et al. | 312/35 |
| 4,135,658 | 1/1979 | Hagberg | 232/43.1 |

*Primary Examiner*—Victor N. Sakran

*Attorney, Agent, or Firm*—Moss, Bensette, Thompson, Squires

[57] ABSTRACT

A self-cleaning bulk food display bin is disclosed which is adapted to be mounted in an opening in a wall. The bin includes a tray with a downwardly and forwardly inclined floor having a debris removal opening located adjacent to a front peripheral wall. A sneeze shield is located above and over the tray to define therebetween a vertical front bun removal opening and a rear bun loading opening. A bottom downwardly and rearwardly disposed panel conveys debris passing through the debris removal opening rearwardly behind the wall.

11 Claims, 3 Drawing Figures

BULK FOOD DISPLAY BIN

This invention relates to display bins, and in particular to self-serve bins for the merchandising of bulk food items.

In the past, food products have been sold in bulk form in supermarkets, restaurants and the like by being displayed in merchandise bins to which the public has had access. Ordinarily, the food products have had to be individually wrapped for sanitary reasons, but it has been desirable to avoid this individual wrapping, if possible. Some health authorities, however, have required elaborate means for isolating the bulk unwrapped food products from the customers handling them, or at least to prevent customers from breathing, sneezing, etc. on the food products. In addition, it has been necessary to clean the bulk display bins daily, or even more frequently, in order to satisfy health regulations.

The present invention provides a self-cleaning bulk food display bin with improved means for isolating the food products displayed therein from undesirable human contact.

According to the invention, there is provided a bulk food display bin for displaying buns and the like. The bin comprises a tray having a downwardly and forwardly inclined floor and front and side peripheral walls. The floor defines a lower opening adjacent to the front wall for the passage of debris therethrough. A sneeze shield is located above and over the tray floor. The sneeze shield and the front wall define a generally vertical bun removal opening. The sneeze shield and the floor define a rear bun loading opening. Also, means is located below the lower opening for receiving debris passing therethrough.

A preferred embodiment of the invention will now be described, by way of example, with reference to the accompanying drawings, in which.

Figure 1:
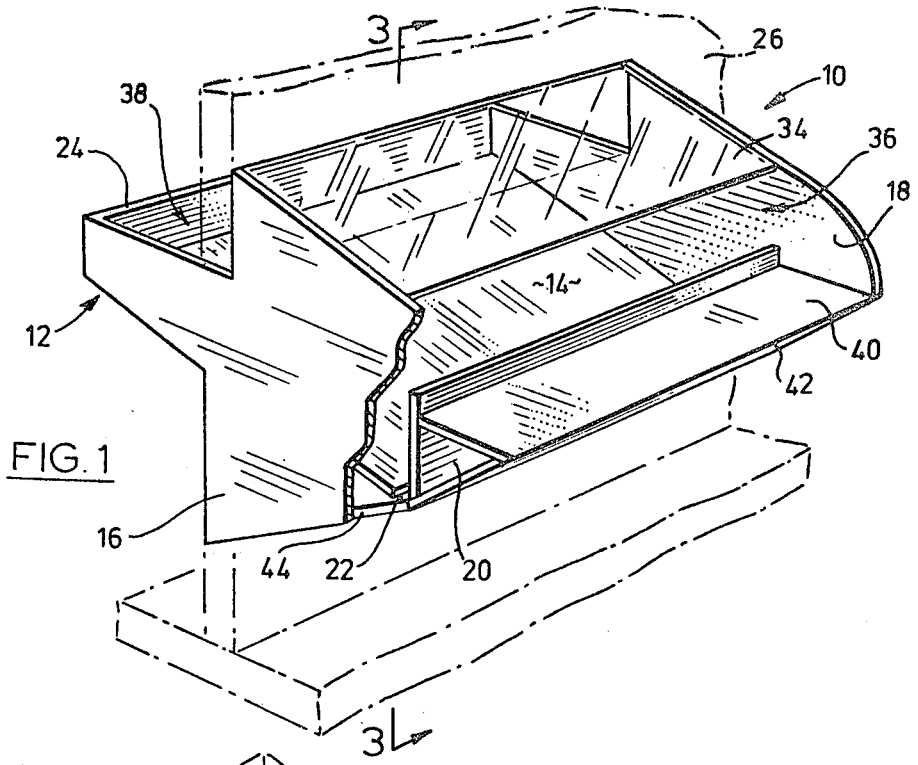
FIG. 1 is a front perspective view, partly broken away, of a preferred embodiment of a bulk food display bin according to the present invention.

Referring to the drawings, a preferred embodiment of a bulk food display bin according to the present invention is generally indicated by reference numeral 10. Display bin 10 is particularly useful for displaying buns, rolls, bread and other similar products, which are loaded into display bin 10 in bulk without being individually wrapped. For the purposes of the present description the term "buns" will be used as an example of the kind of product which could be displayed in display bin 10, but it will be understood that the use of display bin 10 is not intended to be limited in any way, in that other foods products could be merchandised using display bin 10 as desired.

Figure 3:
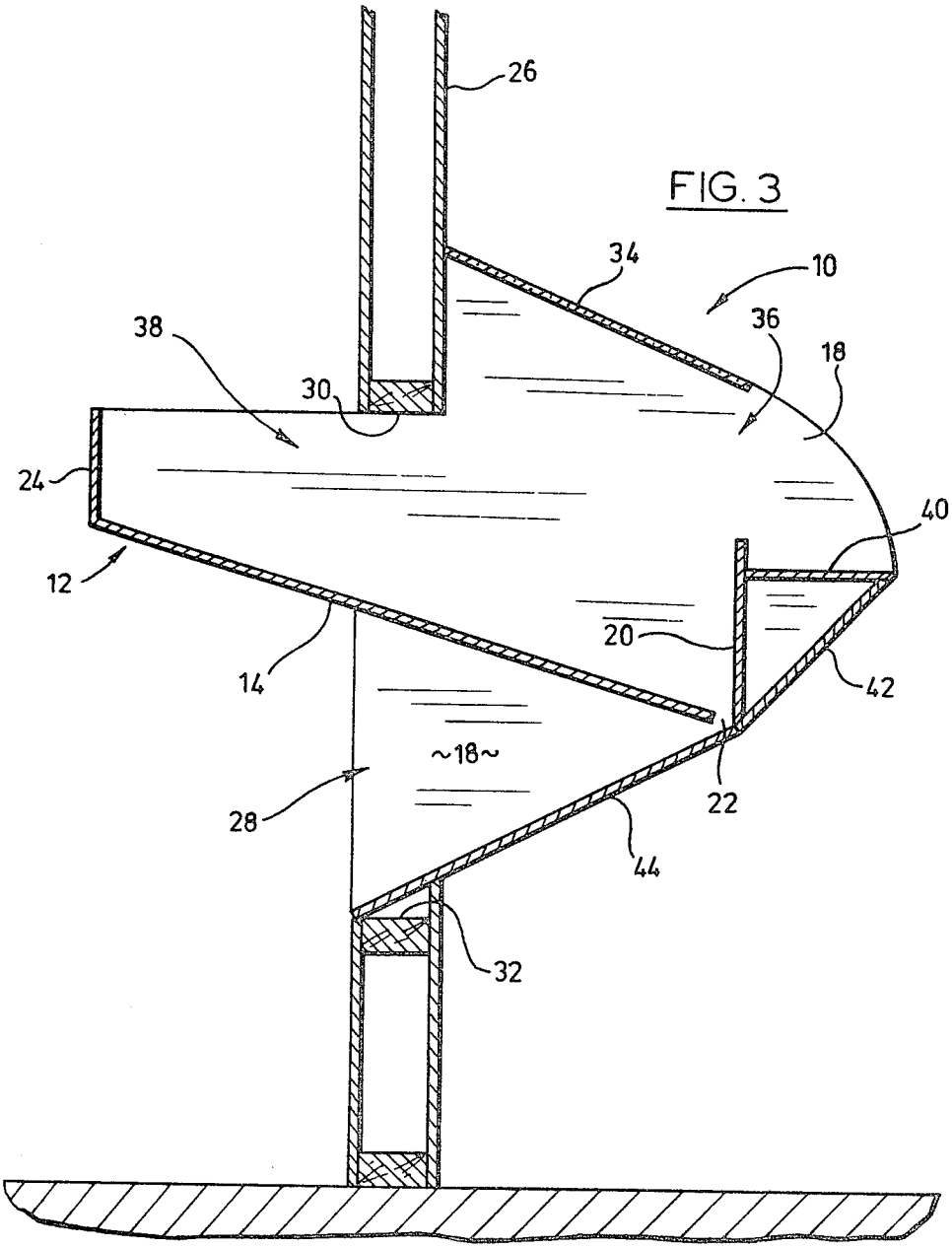
FIG. 3 is a sectional view taken along lines 3—3 of FIG. 1.

Display bin 10 includes a tray 12 having a downwardly and forwardly inclined floor 14 and side peripheral walls 16, 18. Tray 12 also has a front peripheral wall 20. Floor 14 stops short of front wall 20 as seen best in FIG. 3 to form a lower opening 22 adjacent to front wall 20. Lower opening 22 extends along the full length of front wall 20, or across the full width of display bin 10 between side walls 16, 18. Floor 14 also includes a rear upstanding peripheral portion 24.

Figure 2:
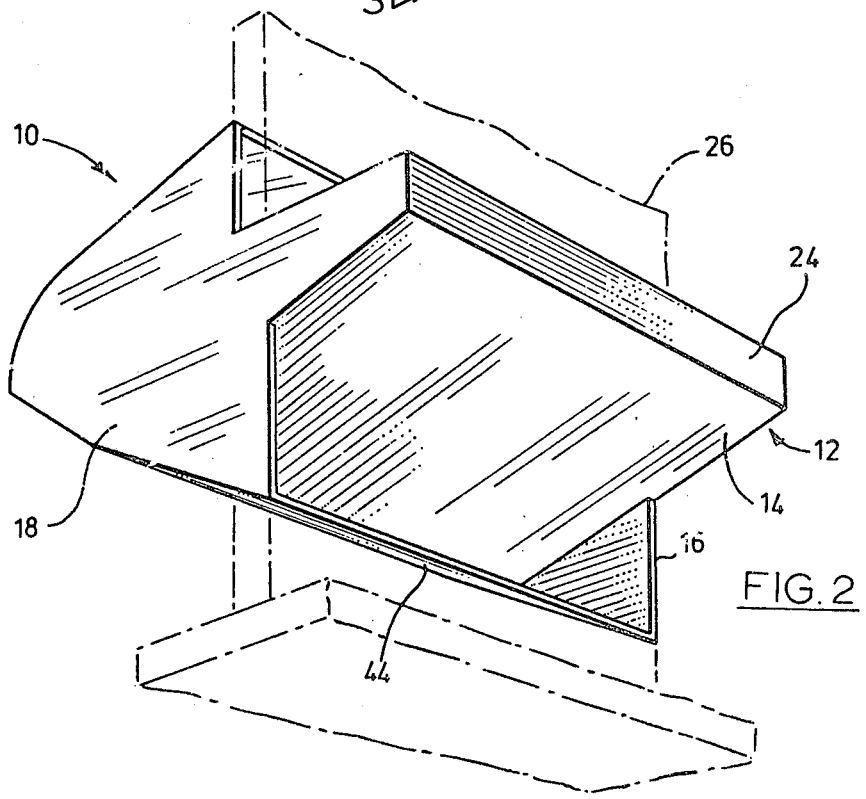
FIG. 2 is a rear perspective view of the embodiment of the display bin shown in FIG. 1.

Display bin 10 is intended to be mounted in an opening in a wall 26. Wall 26 is shown in chain dotted lines in FIGS. 1 and 2, and in solid lines in FIG. 3. The opening in wall 26 in which display bin 10 is located is generally indicated by reference numeral 28 in FIG. 3. Opening 28 is the same width as display bin 10. The upper limit of the opening is defined by an upper peripheral edge portion 30 of wall 26, and the lower limit of opening 28 is defined by a lower peripheral edge portion 32 of wall 26. Tray 12 passes through wall opening 28 with floor 14 intermediate the upper and lower peripheral edge portions 30, 32.

Display bin 10 also includes a transparent sneeze shield 34 formed of acrylic plastic material. Shield 34 is located above and over tray floor 14 so that shield 34 and front wall 20 form a generally vertical bun removal opening 36 in the front of display bin 10. Shield 34 is attached to respective side walls 16, 18, and shield 34 extends rearwardly to engage wall 26 above the upper peripheral edge 30 of opening 28. Sneeze shield 34 and floor 14 also form the boundaries of a rear bun loading opening 38. When display bin 10 is mounted in wall 26, the upper peripheral edge portion 30 of wall 26 extends into the bun loading opening 38 as seen best in FIG. 3.

The front wall 20 of display bin 10 also includes a horizontal forwardly extending shelf 40 and a downwardly and rearwardly inclined decorative panel 42. A downwardly and rearwardly disposed bottom panel 44 is attached to front wall 20 adjacent to lower opening 22. Bottom panel 44 extends through wall opening 28, as seen best in FIG. 3.

In a typical installation, display bin 10 is mounted in a wall 26 so that the bun loading opening 38 is located behind wall 26 in an area not accessible to the public. The front side of display bin 10 which includes bun removal opening 36 extends into the area of a shop or store where merchandise for sale is displayed for public view. Buns or similar food products are loaded into display bin 10 from behind the wall 26 by dumping the buns into tray 12 through bun loading opening 38. Buns roll down floor 14 toward front wall 20 where they may be viewed by the public through sneeze shield 34 and bun removal opening 36. A purchaser selects the buns he wishes to purchase and removes same from display bin 10 through bun removal opening 36. Shelf 40 may be used to support containers for the buns selected.

Display bin 10 is self-cleaning in that any debris, such as crumbs and the like, travel down tray floor 14 and pass through lower opening 22. This debris is received by bottom panel 44 and is conveyed rearwardly behind wall 26 by panel 44. A suitable container can be placed behind wall 26 to catch the crumbs coming off bottom panel 44, or the crumbs can be left to fall on the floor and be swept up when necessary. It will be apparent that lower opening 22 is dimensioned so that it is narrower than the food products to be displayed in bin 10, so that only debris passes through lower opening 22 and not the food products to be displayed in the bin.

Sneeze shield 34 in combination with the vertical orientation of bun removal opening 36 helps isolate the food products in display bin 10 from undesirable human contact, such as breathing, sneezing or coughing on the food products by persons standing before display bin 10.

Having described a preferred embodiment of the invention, it will be apparent that various modifications may be made to the structure described. For example, display bin 10 does not have to be mounted in a wall. Other suitable means could be used to support the display bin. However, it is desirable for sanitary reasons that the purchasing public only have access to the front of the display bin in the area of bun removal opening 36. Sneeze shield 34 could be supported in other ways than by being attached to side walls 16, 18. Sneeze shield 34 could also be formed of other materials, such as glass.

Bottom panel 44 could be replaced by some other means for receiving the debris passing through lower opening 22. It is preferable that the debris be kept out of public view. For this purpose, a suitable container could be located below lower opening 22 to receive the debris rather than have bottom panel 44 convey the debris to a location out of public view.

It will be appreciated that the above invention provides a very convenient self-cleaning display bin, which is particularly useful for the display of bulk unwrapped food items, where for sanitary reasons, the food items must be somewhat isolated from undesirable human contact.

What I claim is:

1. A bulk food display bin for displaying buns and the like, the bin comprising:

a tray having a downwardly and forwardly inclined floor and front and side peripheral walls, the floor defining a lower opening adjacent to said front wall for the passage of debris therethrough wherein said lower opening is narrower than the food to be displayed in the bin to prevent passage through said lower opening of the food to be displayed;

a sneeze shield located above and over the tray floor, the sneeze shield and said front wall defining a generally vertical bun removal opening, the sneeze shield and said floor defining a rear bun loading opening; and means located below said lower opening for receiving debris passing therethrough.

2. A bulk food display bin for displaying buns and the like as claimed in claim 1 wherein said debris receiving means comprises a downwardly and rearwardly disposed bottom panel attached to said front wall adjacent to said lower opening to convey debris rearwardly.

3. A bulk food display bin for displaying buns and the like as claimed in claim 2 wherein said bin is dimensioned to be located in an opening in a wall, the tray passing through said wall opening with the floor intermediate the upper and lower peripheral edges of said opening, said bottom panel being adapted to extend through said opening to convey debris behind said wall.

4. A bulk food display bin for displaying buns and the like as claimed in claim 3 wherein said sneeze shield is adapted to extend rearwardly and engage said wall above said opening upper peripheral edge.

5. A bulk food display bin for displaying buns and the like as claimed in claim 1 wherein said floor lower opening extends along the full length of said front wall.

6. A bulk food display bin for displaying buns and the like as claimed in claim 2 wherein said front wall includes a horizontal forwardly extending shelf.

7. A bulk food display bin for displaying buns and the like as claimed in claim 2 wherein the tray floor further comprises a rear upstanding peripheral portion.

8. A bulk food display bin for display buns and the like as claimed in claim 2 wherein the sneeze shield is attached to said side peripheral walls.

9. A bulk food display bin for displaying buns and the like as claimed in claim 2 wherein the sneeze shield is transparent.

10. A bulk food display bin for displaying buns and the like as claimed in claim 2 wherein said lower opening extends along the full length of said front wall.

11. A bulk food display bin for displaying buns and the like as claimed in claim 3 wherein said sneeze shield is transparent, and wherein said sneeze shield is attached to said side peripheral walls.

* * * * *